US006132933A

United States Patent [19]

Nguyen

[11] Patent Number: 6,132,933

[45] Date of Patent: Oct. 17, 2000

[54] THERMAL WATERLESS LITHOGRAPHIC PRINTING PLATES

[75] Inventor: Ny T. Nguyen, Kirkland, Canada

[73] Assignee: American Dye Source, Inc., Mount Royal, Canada

[21] Appl. No.: 09/363,920

[22] Filed: Jul. 30, 1999

[51] Int. Cl.[7] ..... G06C 1/76

[52] U.S. Cl. ..... 430/272.1; 430/275.1; 101/454

[58] Field of Search ..... 430/270.1, 272.1, 430/275.1, 303; 101/454

[56] References Cited

U.S. PATENT DOCUMENTS

| | | | |
|---|---|---|---|
| 5,221,751 | 6/1993 | Acker et al. | 548/455 |
| 5,310,869 | 5/1994 | Lewis et al. | 430/272 |
| 5,339,737 | 8/1994 | Lewis et al. | 101/454 |
| 5,379,698 | 1/1995 | Nowak et al. | 101/454 |
| 5,487,338 | 1/1996 | Lewis et al. | 101/454 |
| 5,871,883 | 2/1999 | Hirano et al. | 430/272.1 |

FOREIGN PATENT DOCUMENTS

| | | |
|---|---|---|
| 0 764 522 | 3/1997 | European Pat. Off. . |
| WO 94/01280 | 1/1994 | WIPO . |
| WO 97/00715 | 1/1997 | WIPO . |
| WO 97/06956 | 2/1997 | WIPO . |
| WO 98/31550 | 7/1998 | WIPO . |
| WO 99/11467 | 3/1999 | WIPO . |

*Primary Examiner*—Cynthia Hamilton
*Assistant Examiner*—Barbara Gilmore
*Attorney, Agent, or Firm*—Goudreau Gage Dubuc

[57] ABSTRACT

The invention relates to thermal waterless lithographic printing plates comprising layers of inherent near infrared absorbing polymers for computer-to-plate and digital-offset-press technologies. More specially, this invention relates to thermal waterless lithographic printing plates, which can be imaged with near infrared laser light and which do not require post chemical processing step.

More particularly, the present invention provides a thermal waterless printing plate suitable for near infrared laser imaging, said printing plate comprising:

(i) a support substrate, and (ii) a composite top layer consisting of:

(a) a near infrared absorbing adhesion promoting layer applied to the support substrate and (b) a near infrared absorbing ink repelling cross-linked silicone polymer layer.

10 Claims, No Drawings

THERMAL WATERLESS LITHOGRAPHIC PRINTING PLATES

BACKGROUND OF THE INVENTION

1. Field of the Invention

The invention relates to thermal waterless lithographic printing plates comprising layers of inherent near infrared absorbing polymers for computer-to-plate and digital-offset-press technologies. More specially, this invention relates to thermal waterless lithographic printing plates, which can be imaged with near infrared laser light and which do not require post chemical processing step.

2. The Prior Art

Thermal waterless lithographic printing plates are known. For example, U.S. Pat. Nos. 5,310,869 and 5,339,737 describe thermal waterless lithographic printing plates comprising an ink-repelling layer overlying a near infrared absorbing imaging layer. The ink-repelling layer is transparent to radiation and comprises mainly cross-linked silicone polymers. The near infrared absorbing imaging layer contains binder resins and near infrared absorbing materials, such as carbon black and molecular dyes. These thermal waterless lithographic printing plates require high doses of laser energy to ablate the near infrared absorbing layer and weaken the adhesion of the ink repelling cross-linked silicone polymer layer. In addition, the exposed area of the plate must be removed during a further chemical processing step to become an image area.

U.S. Pat. No. 5,379,698 also describes thermal waterless lithographic printing plates, which comprise ink repelling cross-linked silicone polymers overlying a thin metallic or metal oxide film of titanium deposited on a substrate as a laser imaging layer. In a similar technology, U.S. Pat. No. 5,487,338 teaches to use an infrared reflective layer situated below the near infrared absorbing layer. Manufacturing of such printing plates requires vacuum deposition of the corresponding metals. Hence it is very expensive.

WO9831550, WO9700175 and WO9401280 also describe thermal waterless lithographic printing plates, which comprise a layer of ink repelling cross-linked silicone polymers overlying a near infrared absorbing imaging layer containing binder resins and near infrared absorbing pigments, dyes or thin metal films. Again, such thermal waterless lithographic printing require high laser energy doses for imaging.

WO9706956 also describes thermal waterless lithographic printing plates, which comprise a near infrared absorbing layer containing binder resins and near infrared absorption dyes or pigments, and a overlying transparent hydrophobic layer containing fluorinated polymeric materials soluble in fluorinated solvents. Upon exposure to near infrared laser radiation, the exposed area is ablated and accepts ink, while the non-exposed area still repels ink. One drawback of such plates is that the non-exposed area is sensitive to handling and easily becomes dirty on press.

EP0764522 also provides a thermal waterless printing plate containing a near infrared transparent cross-linked silicone polymer ink repelling layer and a near infrared absorbing imaging layer. The ink repelling layer and near infrared absorbing imaging layers contain cross-linked functionality, which form interlayer cross-linked bonds to increase the run length on press. Such printing plate requires high laser energy doses for imaging and requires a chemical processing step.

WO9911467 also provides a thermal waterless lithographic printing plate, comprising a layer of ink repelling cross-linked silicone polymer overlying a near infrared absorbing imaging layer containing polyurethane resins and near infrared absorption dyes. Although, such printing plate exhibits faster laser imaging speed, they are very sensitive to the different developers used in the final chemical processing step.

Thus there remains a need for an improved thermal waterless lithographic printing plate which overcomes the drawbacks of the prior art.

The main objects is to provide lithographic printing plate coating compositions which combine the advantages of: long-life printing plates, absence of phase separation of the overlaid coatings, easily manufactured and inexpensive coating formulations, coatings which may be precisely and rapidly imaged with laser accuracy.

SUMMARY OF THE INVENTION

This invention relates to thermal waterless lithographic printing plates for computer-to-plate and digital-offset-press technologies. More specially, this invention relates to thermal lithographic printing plates comprising:

In general terms, the present invention provides a thermal waterless printing plate suitable for near infrared laser imaging, said printing plate comprising:

(i) a support substrate, and (ii) a composite top layer consisting of:

(a) a near infrared absorbing adhesion promoting layer applied to the support substrate and (b) a near infrared absorbing ink repelling cross-linked silicone polymer layer.

Also provided are coatings for making the printing plate of the present invention.

The thermal waterless lithographic printing plates of this invention can be imaged with near infrared laser lights having a radiation between about 780 and about 1200 nm. Depending on the laser imaging energy doses, the imaged plates may not require post chemical processing step.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DETAILED DESCRIPTION OF THE INVENTION

This invention relates to thermal waterless lithographic printing plates for computer-to-plate and digital-offset-press technologies. More specially, this invention relates to thermal waterless lithographic printing plates, which can be imaged with near infrared laser light having a radiation between about 780 and about 1200 nm. The thermal waterless lithographic printing plates of this invention comprise (I) a support substrate, and (II) a composite top layer consisting of an inherent near infrared absorbing ink-repelling composite comprising inherent near infrared absorbing polymers.

Support Substrate:

The support substrate of this invention may be any sheet material such as metal, plastic and paper. The surface of the substrate may be treated to enhance the adhesion by techniques known in the art. For example, the surface of aluminum sheet may be treated by metal finishing techniques including electrochemical roughening, chemical roughening, mechanical roughening, anodizing and the like. The surface of plastic sheets may be modified by corona treatment and chemical etchings.

The Near Infrared Absorbing Ink Repelling Composite Layer:

The near infrared absorbing ink repelling composite layer of this invention comprises (a) a near infrared absorbing adhesion promoting layer, which is applied between a support substrate and (b) a near infrared absorbing ink repelling cross-linked silicone polymer layer.

(a) The near infrared absorbing adhesion promoting layer comprises mainly inherent near infrared absorbing polymer having reactive functionality, which can form covalent bonds with the near infrared absorbing ink repelling cross-linked silicone polymer layer. The near infrared absorbing adhesion promoting polymers exhibit strong absorption band between 780 and 1200 nm. The preferred class of near infrared absorbing polymers of this invention is urethane polymers, which are obtained from the reactions of alkyl or aryl compounds containing diisocyanate functional groups with near infrared absorption chromophore containing alcohol functional groups and certain tertiary alcohol. The inherent near infrared absorbing polyurethane of this invention may be represented according to formula I.

Formula I

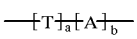

wherein a and b represent molar ratios, which vary from 0.1 to 0.9.

T represents near infrared transparent repeating segment, which may have a structure according to Formula II, III, IV, and V.

Formula II

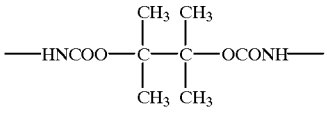

Formula III

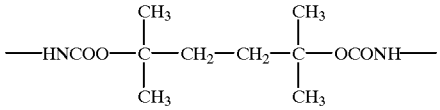

Formula IV

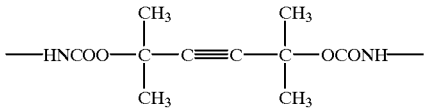

Formula V

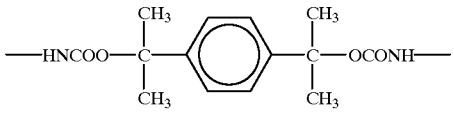

A represents near infrared absorbing repeating segment, which may have a structure according the Formula VI.

Formula VI

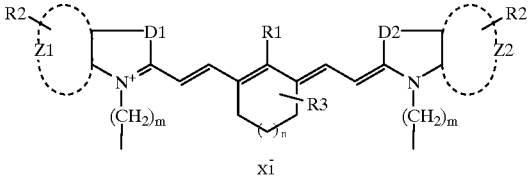

wherein

Z1 and Z2 represent sufficient atoms to form a fused substituted or unsubstituted aromatic rings, such as phenyl and naphthyl.

D1 and D2 represent —O—, —S—, —Se—, —CH═CH—, and —$C(CH_3)_2$—,

R1 and R2 represent alkyl, alkyloxy, alkyl halide, alkyl pyridine, allyloxy, vinyloxy, alkylthio, arylthio, aminothiophenol, sulfoalkyl, and carboxyalkyl substitution.

R3 represents hydrogen, alkyl, and aryl substitution.

X1 represents an anionic counter ion selected from bromide, chloride, iodide, tosylate, triflate, trifluoromethane carbonate, dodecyl benzosylfonate and tetrafluoroborate.

n represents 0 and 1.

m varies from 1 to 18.

The inherent near infrared absorbing polymers of this invention exhibit strong absorption band between 780 and 1200 nm. They may have glass transition temperature between 110 and 150° C. and decomposition temperature between 180 and 300° C.

Optionally, the near infrared absorbing adhesion promoting layer of this invention may contain binder resins, which are transparent to near infrared radiation. The preferred binder resins are polymers containing monomer units derived from nitrocellulose, hydroxyalkylcellulose, styrene, carbonate, amide, urethane, acrylate, vinyl alcohol, and ester.

Upon exposure to near infrared radiation between 780 and 1200 nm, the near infrared absorption segments containing in the polymer backbone convert the photo-energy into heat, which induce the thermal fragmentation and decomposition of the near infrared transparent segments via cleavage mechanism described by Foley et. al. (U.S. Pat. No. 5,156,938) according to Formula VII.

Formula VII

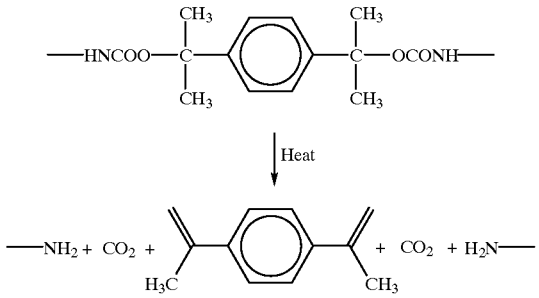

(b) The near infrared absorbing ink-repelling layer of this invention comprises cross-linked silicone polymers having near infrared absorption repeating units. The near infrared absorbing repeating units form covalent bonds with the cross-linked silicone polymeric networks according to Formula VII, IX and X:

Formula VIII

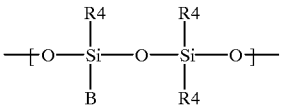

Formula IX

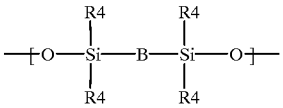

Formula X

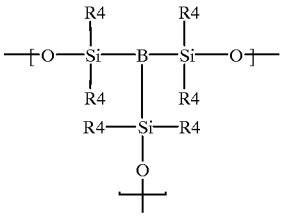

wherein

—$(R4)_2$—Si—O— represents a cross-linked silicone polymeric networks.

R4 represents methyl, ethyl and aryl substitution of the cross-linked silicone polymeric networks.

B represents near infrared absorbing repeating units, which exhibits strong absorption bands between 780 and 1200 nm. The near infrared absorption repeating units comprise derivatives of indole, benz[e]indole, benz[cd]indole, benzothiazole, napthothiazole, benzoxazole, napthoxazole, benzselenazole, and napthoselenazole, which can be represented according to Formula XI, XII and XIII:

Formula XI

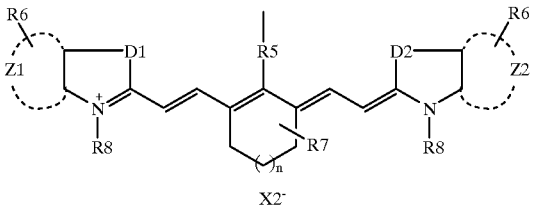

Formula XII

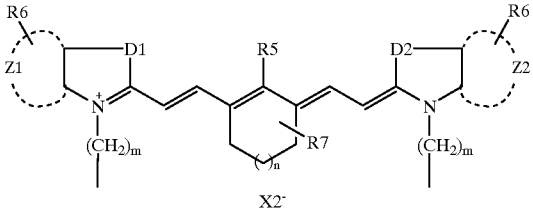

-continued

Formula XIII

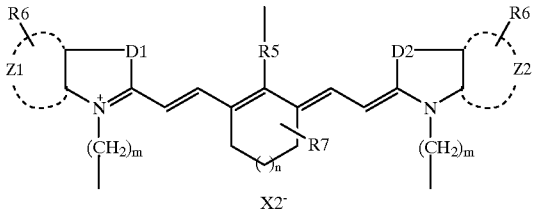

wherein

Z1 and Z2 represent sufficient atoms to form a fused substituted or unsubstituted aromatic rings, such as phenyl and naphthyl.

D1 and D2 represent —O—, —S—, —Se—, —CH═CH—, and —$C(CH_3)_2$—,

R5 represents alkyl, alkyloxy, alkyl halide, pyridine, alkyl pyridine and alkylthio.

R6 represents alkyl, sulfonyl alkyl, and carboxy alkyl substitution.

R7 represents hydrogen, alkyl and aryl substitution.

R8 represents alkyl, benzyl, alkyl amine, alkyl sulfonic acid, alkyl carboxylic acid substitution.

X2 represents an anionic counter ion selected from bromide, chloride, iodide, tosylate, triflate, trifluoromethane carbonate, dodecyl benzosylfonate and tetrafluoroborate.

n represents 0 and 1.

m varies from 1 to 18.

The near infrared absorbing ink repelling cross-linked silicone polymers of this invention may be obtained by the in-situ addition reactions of poly(hydroalkylsiloxane) with poly(dialkylsiloxane) and near infrared absorption molecules containing alkenyl functional groups under presence of metal complex catalysts, such as hydrogen hexachloro platinate. They may also be obtained by the condensation reactions of poly(dialkylsiloxane) containing silanol functional groups with organic compounds containing acyloxy or alkoxy silane functional groups under presence of carboxylic acid salt of zinc, tin, iron or titanium catalyst.

Upon exposure to near infrared radiation between 780 and 1200 nm, the near infrared absorption segments containing in the cross-linked silicone polymer backbone convert the photo-energy into heat, which induces the thermal fragmentation and decomposition of the polymeric networks. The thermal fragmentation of the near infrared absorbing ink repelling layer combining with thermal fragmentation of the near infrared absorbing adhesion promoting beneath layer result in the formation of low molecular weight materials. These decomposed products are easily removed by the printing inks on the printing press during roll up period. The laser exposure area eventually becomes accepting inks and the non-exposure area still repelling inks.

Synthesis of Near Infrared Absorbing Adhesion Promoting Polymers:

All the polymerization was performed in a three-neck flask reactor equipped with magnetic stirrer, heating metal, temperature controller, water condenser, and nitrogen inlet. The completion of the reaction was followed by infrared spectrophotometer. The optical and thermal characteristics of the obtained polymers were characterized by spectroscopic and differential scanning calorimetric techniques.

Synthesis of Inherent Near Infrared Absorbing Adhesion Promoting Polymers: Examples 1 to 5

EXAMPLE 1

Synthesis of Near Infrared Absorption Polymer ADS-001-CTP

Near infrared absorption polymer ADS-00-1CTP was synthesized by slowly adding 21.2 parts of trimethyl-1,6-diisocyanatohexane (available from Aldrich Chemicals) into a solution containing 100 parts of N-methyl pyrrolidinone, 6.8 parts of 2-[2-[2-choloro-3-[2-(1,3-dihydro-1-(2-hydroxyethyl)-3,3-dimethyl-2H-benz[e]indol-2-ylidene) ethylidene]-1-cyclohexene-1-yl]ethenyl]-1-(2-hydroxyethyl)-3,3-dimethyl-1H-benz[e]indolium perchlorate (available from American Dye Source, Inc.), 18.0 parts of a,a,a',a'-tetramethyl-1,4-benzenedimethanol (available from Aldrich Chemicals) and 0.5 parts of dibutyltin dilaurate (available from Aldrich Chemicals) at 60° C. under nitrogen atmosphere and constant stirring. Completion of the polymerization was indicated by the disappearance on NCO absorption bands in the infrared spectra. The product was precipitated in water and then collected by vacuum filtration, washed copiously with water and dried in air until constant weight.

The obtained near infrared absorption polymer has glass transition and decomposition temperatures at around 133° C. and 214° C., respectively. The film of near infrared absorption polymer ADS-001-CTP on polyester film shows a broad absorption band having a maximum at around 842 nm. The ideal structure of ADS-001-CTP can be represented as following:

EXAMPLE 2

Synthesis of Near Infrared Absorption Polymer ADS-002-CTP

Near infrared absorption polymer ADS-002-CTP was synthesized by slowly adding 26.0 parts of methylene bis (4-cyclohexylisocyanate) (available from Bayer) into a solution containing 100 parts of N-methyl pyrrolidinone, 6.8 parts of 2-[2-[2-choloro-3-[2-(1,3-dihydro-1-(2-hydroxyethyl)-3,3-dimethyl-2H-benz[e]indol-2-ylidene) ethylidene]-1-cyclohexene-1-yl]ethenyl]-1-(2-hydroxyethyl)-3,3-dimethyl-1H-benz[e]indolium perchlorate (available from American Dye Source, Inc.), 18.0 parts of a,a,a',a'-tetramethyl-1,4-benzenedimethanol (available from Aldrich Chemicals) and 0.5 parts of dibutyltin dilaurate (available from Aldrich Chemicals) at 60° C. under nitrogen atmosphere and constant stirring. Completion of the polymerization was indicated by the disappearance on NCO absorption bands in the infrared spectra. The product was precipitated in water and then collected by vacuum filtration, washed copiously with water and dried in air until constant weight. The ADS-002-CTP near infrared absorbing polymer has the glass transition and decomposition temperatures at around 132° C. and 214° C., respectively. The film of near infrared absorption polymer ADS-002-CTP on polyester film shows a broad absorption band having a maximum at around 839 nm. The ideal structure of ADS-002-CTP can be represented as following:

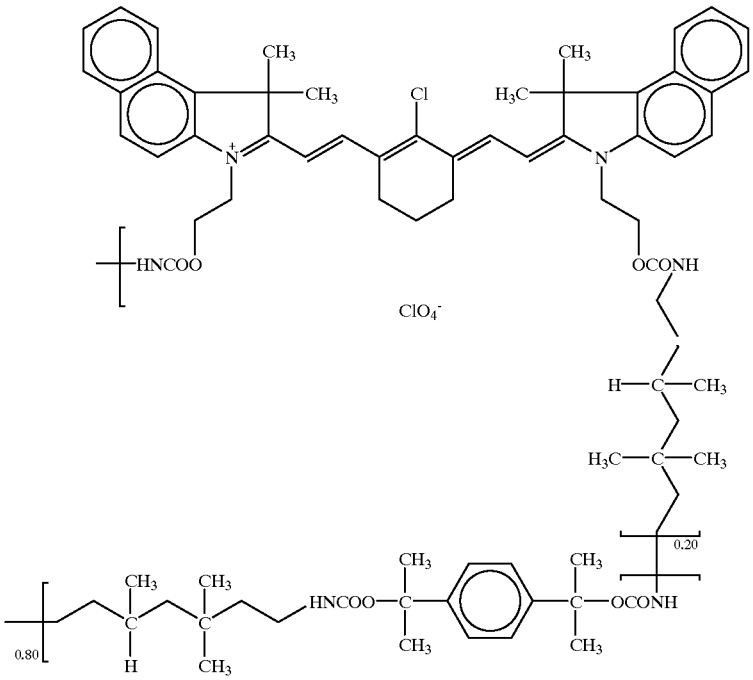

Structure of ADS-001-CTP

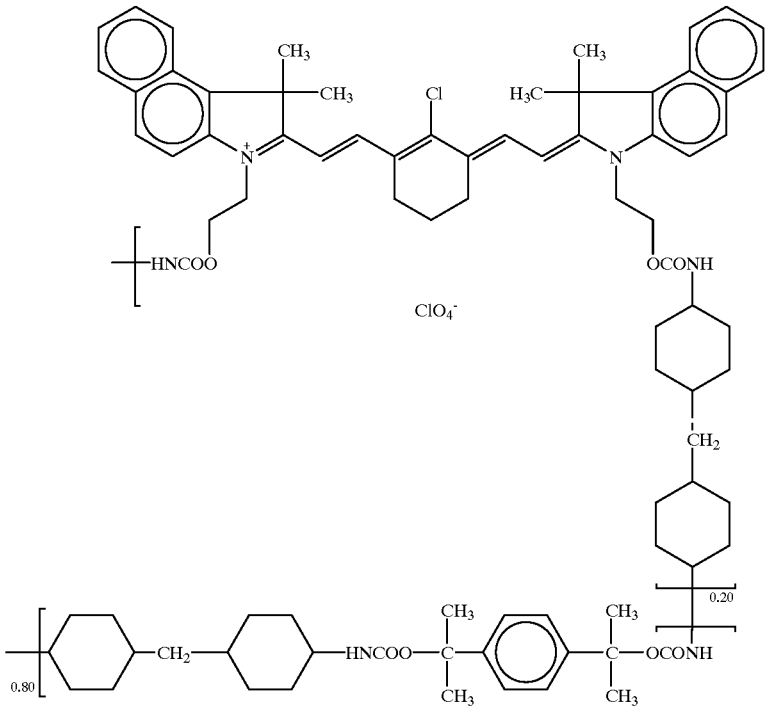

Structure of ADS-003-CTP

EXAMPLE 3

Synthesis of Infrared Absorption Polymer ADS-003-CTP

Near infrared absorption polymer ADS-003-CTP was synthesized by slowly adding 21.2 parts of trimethyl-1,6-diisocyanatohexane (available from Aldrich Chemicals) into a solution containing 100 parts of N-methyl pyrrolidinone, 6.4 parts of 2-[2-[2-allyloxy-3-[2-(1,3-dihydro-1-(2-hydroxyethyl)-3,3-dimethyl-2H-benz[e]indol-2-ylidene) ethylidene]-1-cyclohexene-1-yl]ethenyl]-1-(2-hydroxyethyl)-3,3-dimethyl-1H-benz[e]indolium perchlorate (available from American Dye Source, Inc.), 18.0 parts of a,a,a',a'-tetramethyl-1,4-benzenedimethanol (available from Aldrich Chemicals) and 0.5 parts of dibutyltin dilaurate (available from Aldrich Chemicals) at 60° C. under nitrogen atmosphere and constant stirring for 6 hours. To the reaction mixture, 6 parts of sodium allyloxylate in 14 parts of allyl alcohol was slowly added and the reaction was continued for additional 4 hours. The reaction mixture was cooled down to room temperature. The product was precipitated in water and then collected by vacuum filtration, washed copiously with water and dried in air until constant weight. The film of near infrared absorption polymer ADS-003-CTP on polyester film shows a broad absorption band having a maximum at around 832 nm. The ideal structure of ADS-003-CTP can be represented as following:

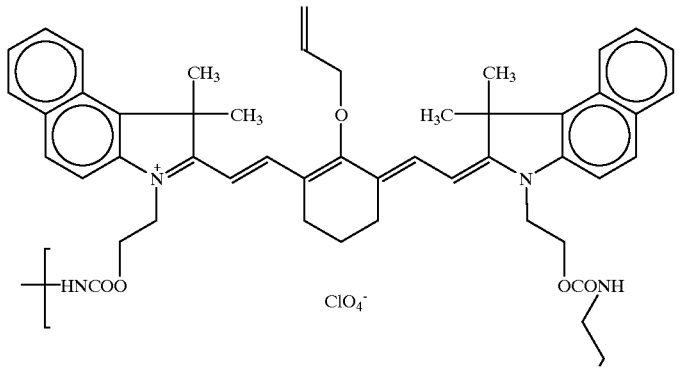

-continued

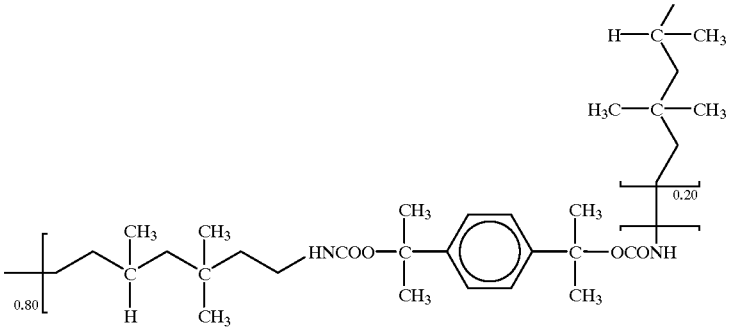

Structure of ADS-003-CTP

EXAMPLE 4

Synthesis of Linear Near Infrared Absorption Polymer ADS-004-CTP

Near infrared absorption polymer ADS-004-CTP was synthesized by slowly adding 26.0 parts of methylene bis (4-cyclohexylisocyanate) (available from Bayer) into a solution containing 100 parts of N-methyl pyrrolidinone, 6.8 parts of 2-[2-[2-choloro-3-[2-(1,3-dihydro-1-(2-hydroxyethyl)-3,3-dimethyl-2H-benz[e]indol-2-ylidene) ethylidene]-1-cyclohexene-1-yl]ethenyl]-1-(2-hydroxyethyl)-3,3-dimethyl-1H-benz[e]indolium perchlorate (available from American Dye Source, Inc.), 11.6 parts of a,a,a',a'-tetramethyl-1,4-benzenedimethanol (available from Aldrich Chemicals), 2.6 parts of 3-allyl-1, 2-propanediol (available from Aldrich Chemical) and 0.5 parts of dibutyltin dilaurate (available from Aldrich Chemicals) at 60° C. under nitrogen atmosphere and constant stirring. Completion of the polymerization was indicated by the disappearance on NCO absorption bands in the infrared spectra. The reaction mixture was cooled down to room temperature. The product was precipitated in water and then collected by vacuum filtration, washed copiously with water and dried in air until constant weight. The ADS-004-CTP near infrared absorbing polymer has the glass transition and decomposition temperatures at around 113 and 210° C., respectively. The film of near infrared absorption polymer ADS-004-CTP on polyester film shows a broad absorption band having a maximum at around 841 nm. The ideal structure of ADS-004-CTP can be represented as following:

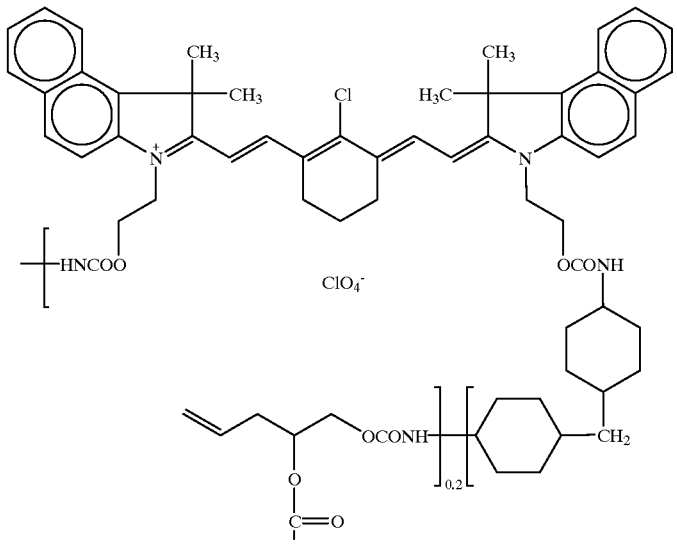

-continued

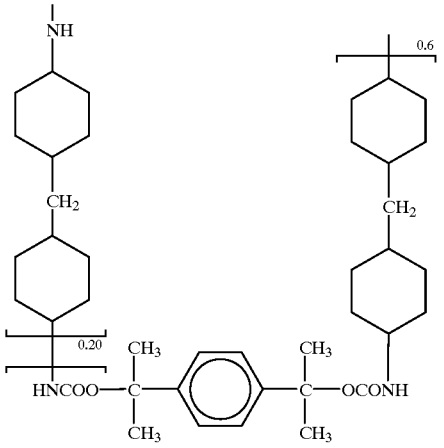

Structure of ADS-004-CTP

EXAMPLE 5

Synthesis of Infrared Absorption Polymer ADS-005-CTP

Near infrared absorption polymer ADS-CTP-005 was synthesized by slowly adding 21.2 parts of trimethyl-1,6-diisocyanatohexane (available from Aldrich Chemicals) into a solution containing 100 parts of N-methyl pyrrolidinone, 6.8 parts of 2-[2-[2-choloro-3-[2-(1,3-dihydro-1-(2-hydroxyethyl)-3,3-dimethyl-2H-benz[e]indol-2-ylidene) ethylidene]-1-cyclohexene-1-yl]ethenyl]-1-(2-hydroxyethyl)-3,3-dimethyl-1H-benz[e]indolium perch orate (available from American Dye Source, Inc.), 11.6 parts of a,a,a',a'-tetramethyl-1,4-benzenedimethanol (available from Aldrich Chemicals), 3.4 parts of 2,6-bis (hydroxymethyl)-p-cresol and 0.5 parts of dibutyl tin (available from Aldrich Chemicals) at 60° C. under nitrogen atmosphere and constant stirring for 6 hours. Completion of the polymerization was indicated by the disappearance on NCO absorption bands in the infrared spectra. The product was precipitated in water and then collected by vacuum filtration, washed copiously with water and dried in air until constant weight. The ADS-005-CTP near infrared absorbing polymer has the glass transition and decomposition temperatures at around 117 and 215° C., respectively. The film of near infrared absorption polymer ADS-005-CTP on polyester film shows a broad absorption band having a maximum at around 841 nm. The ideal structure of ADS-005-CTP can be represented as following:

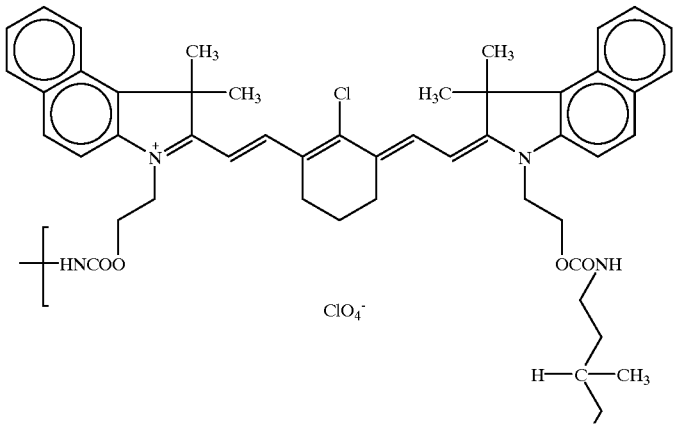

-continued

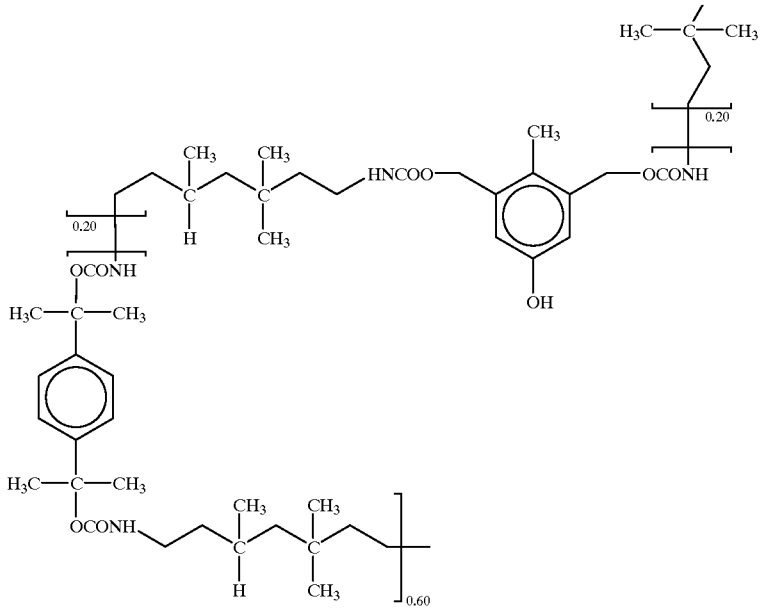

Structure of ADS-005-CTP

Synthesis of Near Infrared Absorbing Cross-linked Silicone Polymers: Examples 6 to 12

EXAMPLE 6

Preparation of Near Infrared Absorbing Ink Repelling Cross-linked Silicone Polymer, ADS-001-Si The near infrared absorbing ink repelling cross-linked silicone polymer was prepared by adding 300 parts of water containing 1.0 part of 2-[2-[2-allyloxy-3-[2-(1,3-dihydro-1-(4-sulfobutyl)-3,3-dimethyl-2H-benz[e]indol-2-ylidene) ethylidene]-1-cyclohexene-1-yl]ethenyl]-1-(4-sulfobutyl)-3,3-dimethyl-1H-benz[e]indolium inner salt (available from American Dye Source, Inc.) into a solution containing 50 parts of reactive silicone polymeric emulsion (Syl-Off 7910, available from Dow Corning, 40% solid weight), 50 parts of silicone polymeric cross-linker emulsion containing platinum catalyst (Syl-Off 7922, available from Dow Corning, 40% solid weight) and 1.5 parts of silicone wetting agent (Q2-5211, available from Dow Corning). The freshly prepared polymeric solution was coated on an anodized aluminum substrate using a wire wound rod. The coating was dried under hot air stream and then further cured at 120° C. for 5 minutes to produce a uniform coating film having a coating weight around 1.0 g/m$^2$. The UV-Vis-NIR spectrum of the resulted polymer on polyester film shows a broad absorption band having a maximum at 840 nm. The ideal structure of the near infrared absorbing ink repelling cross-linked silicone polymer can be represented as following:

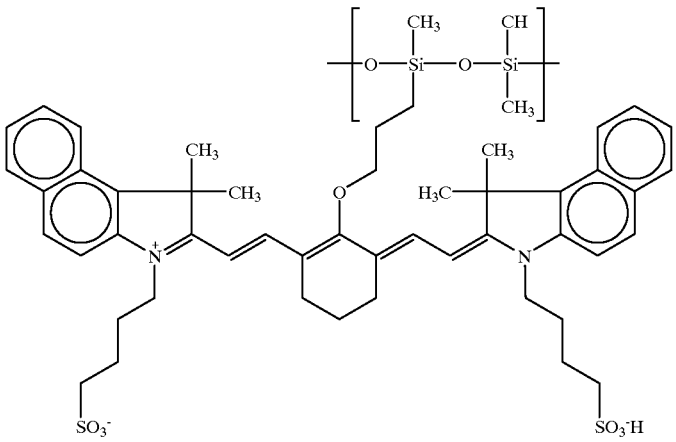

Structure of ADS-001-Si

EXAMPLE 7

Preparation of Near Infrared Absorbing Ink Repelling Cross-linked Silicone Polymer, ADS-002-Si The near infrared absorbing ink repelling cross-linked silicone polymer was prepared by adding 300 parts of water containing 1.0 part of 2-[2-[2-chloro-3-[2-(1,3-dihydro-1-allyl-3,3-dimethyl-7-sulfonyl-2H-benz[e]indol-2-ylidene) ethylidene]-1-cyclohexene-1-yl]ethenyl]-1-allyl-3,3-dimethyl-7-sulfonyl-1H-benz[e]indolium 4-methylbenzenesulfonic acid (available from American Dye Source, Inc.) into a solution containing 50 parts of reactive silicone emulsion (Syl-Off 7910, available from Dow Corning, 40% solid weight), 50 parts of reactive silicone emulsion with platinum catalyst (Syl-Off 7922, available from Dow Corning, 40% solid weight) and 1.5 parts of wetting agent (Q2-5211, available from Dow Corning). The freshly prepared polymeric solution was coated on an anodized aluminum substrate using a wire wound rod. The coating was dried under hot air stream and then further cured at 120° C. for 5 minutes to produce a uniform coating film having a coating weight around 1.0 g/m$^2$. The UV-Vis-NIR spectrum of the resulted polymer on polyester film shows a broad absorption band having a maximum at 842 nm. The ideal structure of the near infrared absorbing ink repelling cross-linked silicone polymer can be represented as following:

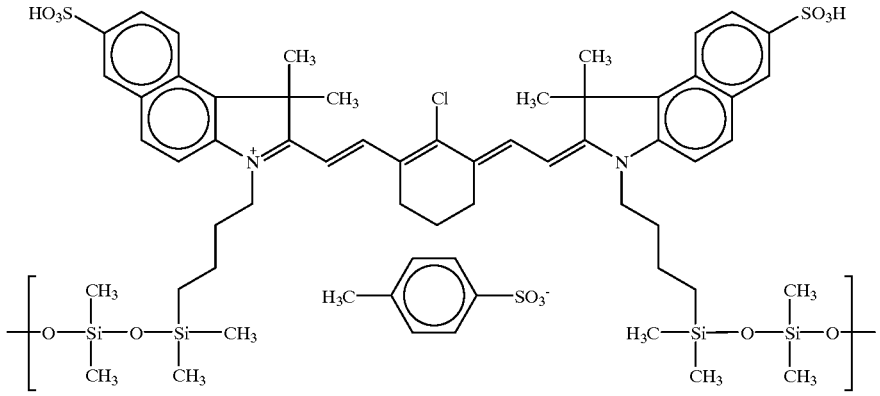

Structure of ADS-003-Si

EXAMPLE 8

Preparation of Near Infrared Absorbing Ink Repelling Cross-linked Silicone Polymer, ADS-003-Si The near infrared absorbing ink repelling cross-linked silicone polymer was prepared by adding 300 parts of water containing 1.0 part of 2-[2-[2-allyloxy-3-[2-(1,3-dihydro-1-allyl-3,3-dimethyl-7-sulfonyl-2H-benz[e]indol-2-ylidene) ethylidene]-1-cyclohexene-1-yl]ethenyl]-1-allyl-3,3-dimethyl-7-sulfonyl-1H-benz[e]indolium 4-methylbenzenesulfonic acid (available from American Dye Source, Inc.) into a solution containing 50 parts of reactive silicone emulsion (Syl-Off 7910, available from Dow Corning, 40% solid weight), 50 parts of reactive silicone emulsion with platinum catalyst (Syl-Off 7922, available from Dow Corning, 40% solid weight) and 1.5 parts of wetting agent (Q2-5211, available from Dow Corning). The freshly prepared polymeric solution was coated on an anodized aluminum substrate using a wire wound rod. The coating was dried under hot air stream and then further cured at 120° C. for 5 minutes to produce a uniform coating film having a coating weight around 1.0 g/m$^2$. The UV-Vis-NIR spectrum of the resulted polymer on polyester film shows a broad absorption band having a maximum at 837 nm. The ideal structure of the near infrared absorbing ink repelling cross-linked silicone polymer can be represented as following:

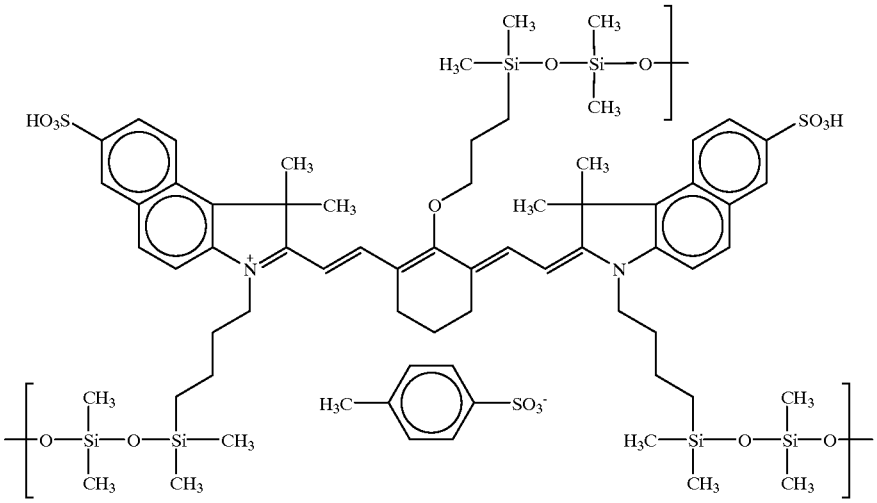

Structure of ADS-003-Si

EXAMPLE 9

Preparation of Near Infrared Absorbing Ink Repelling Cross-linked Silicone Polymer, ADS-004-Si The near infrared absorbing ink repelling cross-linked silicone polymer was prepared by adding a solution containing 10 parts of methyl ethyl ketone dissolving with 0.10 parts of 2-[2-[2-allyloxy-3-[2-(1,3-dihydro-1-heptyl-3,3-dimethyl-2H-benz[e]indol-2-ylidene)ethylidene]-1-cyclohexene-1-yl]ethenyl]-1-heptyl)-3,3-dimethyl-1H-benz[e]indolium 4-methyl benzenesulfonate (available from American Dye Source, Inc.) into a solution containing 2.0 parts of polydimethylsiloxane divinyl terminated (PS445, availble from United Chemical), 1.0 part of high molecular weight polydimethylsiloxane divinyl terminated (PS225, availble from United Chemical), 1.0 part of polyhydromethylsiloxane (SL6020, available from GE Silicones), 0.1 parts of platinum catalyst (PC075, available from United Chemical), 0.06 parts of volatile inhibitor (SL6020, available from GE Silicones) into a solution containing 45 parts of Isoparafin solution (IsoPar-E, available from Exxon Chemical), The solution was filtered to remove any solid residue. The freshly prepared polymeric solution was coated on an anodized aluminum substrate using a wire wound rod. The coating was dried under hot air stream and then further cured at 120° C. for 5 minutes to produce a uniform coating film having a coating weight around 1.0 g/m$^2$. The UV-Vis-NIR spectrum of the resulted polymer on polyester film shows a broad absorption band having a maximum at 835 nm. The ideal structure of the near infrared absorbing ink repelling cross-linked silicone polymer can be represented as following:

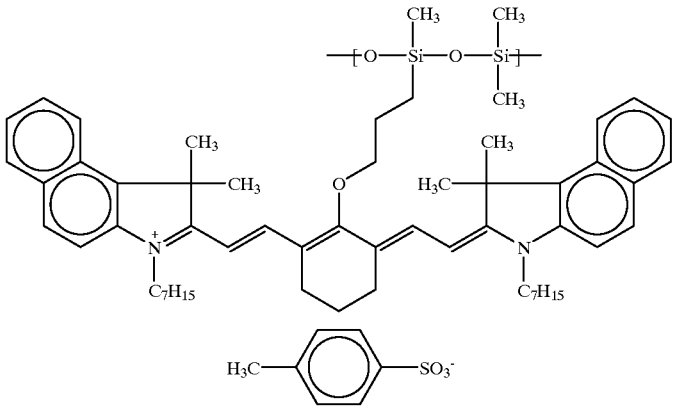

Structure of ADS-004-Si

EXAMPLE 10

Preparation of Near Infrared Absorbing Ink Repelling Cross-linked Silicone Polymer, ADS-005-Si The near infrared absorbing ink repelling cross-linked silicone polymer was prepared similarly to that of Example 4, excepted that 2-[2-[2-dodecyloxy-3-[2-(1,3-dihydro-1-allyl-3,3-dimethyl-2H-benz[e]indol-2-ylidene)ethylidene]-1-cyclohexene-1-yl]ethenyl]-1-allyl-3,3-dimethyl-1H-benz[e]indolium 4-methyl benzenesulfonate (available from American Dye Source, Inc.) was used to replace 2-[2-[2-allyloxy-3-[2-(1,3-dihydro-1-heptyl-3,3-dimethyl-2H-benz[e]indol-2-ylidene)ethylidene]-1-cyclohexene-1-yl]ethenyl]-1-heptyl-3,3-dimethyl-1H-benz[e]indolium 4-methylbenzenesulfonate. The freshly prepared polymeric solution was coated on an anodized aluminum substrate using a wire wound rod. The coating was dried under hot air stream and then further cured at 120° C. for 5 minutes to produce a uniform coating film having a coating weight around 1.0 g/m$^2$. The UV-Vis-NIR spectrum of the resulted polymer on polyester film shows a broad absorption band having a maximum at 829 nm. The ideal structure of the near infrared absorbing ink repelling cross-linked silicone polymer can be represented as following:

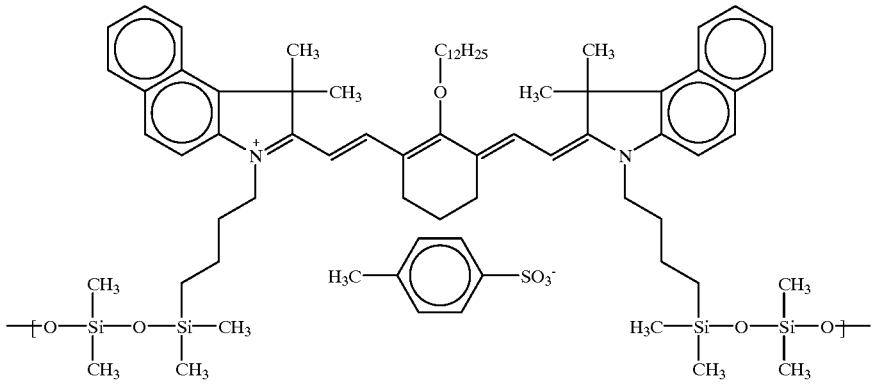

Structure of ADS-005-Si

EXAMPLE 11

Preparation of Near Infrared Absorbing Ink Repelling Cross-linked Silicone Polymer, ADS-006-Si The near infrared absorbing ink repelling cross-linked silicone polymer was prepared similarly to that of Example 4, excepted that 2-[2-[2-dodecyloxy-4-tert-butyl-3-[2-(1,3-dihydro-1-allyl-3,3-dimethyl-2H-benz[e]indol-2-ylidene)ethylidene]-1-cyclohexene-1-yl]ethenyl]-1-allyl-3,3-dimethyl-1H-benz[e]indolium 4-methyl benzenesulfonate (available from American Dye Source, Inc.) was used to replace 2-[2-[2-allyloxy-3-[2-(1,3-dihydro-1-heptyl-3,3-dimethyl-2H-benz[e]indol-2-ylidene)ethylidene]-1-cyclohexene-1-yl]ethenyl]-1-heptyl-3,3-dimethyl-1H-benz[e]indolium 4-methylbenzenesulfonate. The freshly prepared polymeric solution was coated on an anodized aluminum substrate using a wire wound rod. The coating was dried under hot air stream and then further cured at 120° C. for 5 minutes to produce a uniform coating film having a coating weight around 1.0 g/m$^2$. The UV-Vis-NIR spectrum of the resulted polymer on polyester film shows a broad absorption band having a maximum at 829 nm. The ideal structure of the near infrared absorbing ink repelling cross-linked silicone polymer can be 20 represented as follows:

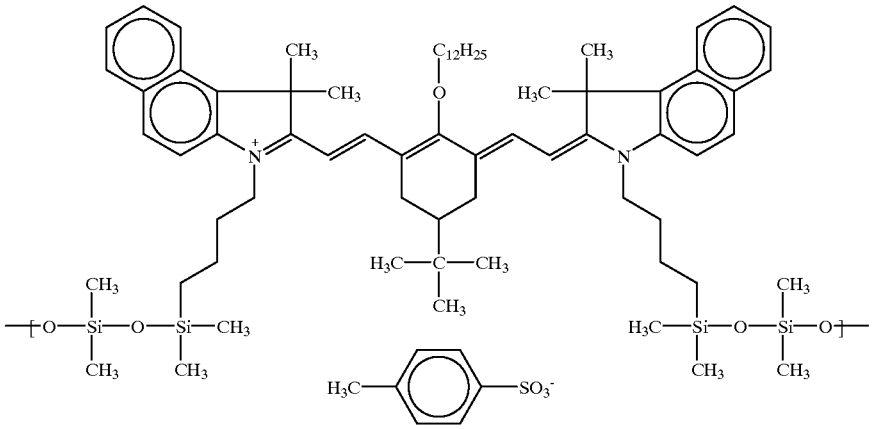

Structure of ADS-006-Si

EXAMPLE 12

Preparation of Near Infrared Absorbing Ink Repelling Cross-linked Silicone Polymer, ADS-007-Si The near infrared absorbing ink repelling cross-linked silicone polymer was prepared similarly to that of Example 4, excepted that 2-[2-[2-allyloxy-3-[2-(1,3-dihydro-1-(octyl-8-ene)-3,3-dimethyl-2H-benz[e]indol-2-ylidene) ethylidene]-1-cyclohexene-1-yl]ethenyl]-1-(octyl-8-ene)-3,3-dimethyl-1H-benz[e]indolium 4-methylbenzenesulfonate (available from American Dye Source, Inc.) was used to replace 2-[2-[2-allyloxy-3-[2-(1,3-dihydro-1-heptyl-3,3-dimethyl-2H-benz[e]indol-2-ylidene)ethylidene]-1-cyclohexene-1-yl]ethenyl]-1-heptyl)-3,3-dimethyl-1H-benz[e]indolium 4-methyl. The freshly prepared polymeric solution was coated on an anodized aluminum substrate using a wire wound rod. The coating was dried under hot air stream and then further cured at 120° C. for 5 minutes to produce a uniform coating film having a coating weight around 1.0 g/m$^2$. The UV-Vis-NIR spectrum of the resulted polymer on polyester film shows a broad absorption band having a maximum at 829 nm. The ideal structure of the near infrared absorbing ink repelling cross-linked silicone polymer can be represented as following:

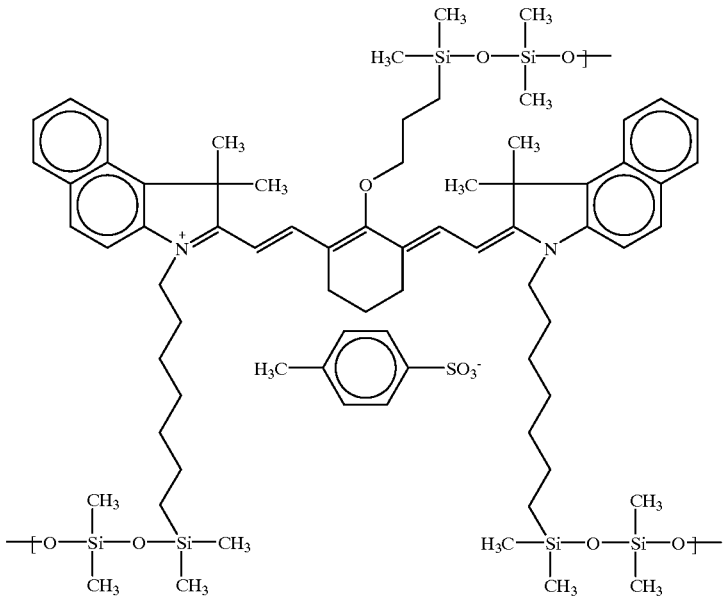

Structure of ADS-007-Si

Preparation and Imaging of Waterless Printing Plates: Examples 13 to 18

EXAMPLE 13

A waterless printing plate was prepared by dissolving 10.0 parts of ADS-001-CTP from Example 1 in 90.0 parts of solvent system containing 35% methoxyethanol, 30% methyl ethyl ketone and 35% methanol. The near infrared absorption polymeric solution was filtered to remove any solid residues. It was than coated on an anodized aluminum substrate using a wire-wound rod and dried under hot air stream at 80° C. for 5 minutes to produce a uniform coating having a coating weight at around 1.5 g/m$^2$. The solution of near infrared absorbing ink repelling cross-linked silicone polymer was prepared similarly to Example 6. It was then coated on the near infrared absorbing adhesion ink promoting layer using a wire-wound rod. The coating was dried under hot air stream and cured at 120° C. for 5 minutes to produce a uniform coating having a coating weight at around 1.0 g/m$^2$. The plate was imaged with a home-built laser image-setter, which was equipped with an aluminum drum, a single beam 1 watt solid state diode laser emitting at 830 nm (available from Optopower) at energy density between 200 and 800 mJ/cm$^2$. The plate was tested on an AB Dick press with Sun Chemical Drilith "H" Cyan Ink (available from Sun Chemical) in the absence of fountain solution. Before printing, the debris at the exposed area was gently cleaned with a cotton cloth wetted with soap water. The exposed area produced high optical printing image while the non-exposed area remained clean. The plate can be printed to more than 10,000 copies without deterioration.

EXAMPLE 14

A waterless printing plate was prepared similarly to the procedure of Example 13, excepted that the near infrared absorbing ink repelling cross-linked silicone polymer layer prepared similarly to Example 7 (i.e., ADS-002-Si) was used to coated on the near infrared absorbing adhesion promoting layer using a wire-wound rod. The coating was dried under hot air and cured at 120° C. for 5 minutes to produce a uniform coating having a coating weight at around 1.0 g/m$^2$. The plate was imaged with a home-built laser image-setter, which was equipped with an aluminum drum, a single beam 1 watt solid state diode laser emitting at 830 nm (available from Optopower) at energy density between 200 and 800 mJ/cm$^2$. The plate was tested on an AB Dick press with Sun Chemical Drilith "H" Cyan Ink (available from Sun Chemical) in the absence of fountain solution. Before printing, the debris at the exposed area was gently cleaned with a cotton cloth wetted with soap water. The exposed area produced high optical printing image while the non-exposed area remained clean. The plate can be printed to more than 10,000 copies without deterioration.

EXAMPLE 15

A waterless printing plate was prepared similarly to the procedure of Example 13, excepted that the near infrared absorbing ink repelling cross-linked silicone polymer layer prepared similarly to Example 8 (i.e., ADS-003-Si) was used to coated on the near infrared absorbing adhesion promoting layer using a wire-wound rod. The coating was dried under hot air and cured at 120° C. for 5 minutes to produce a uniform coating having a coating weight at around 1.0 g/m$^2$. The plate was imaged with a home-built laser image-setter, which was equipped with an aluminum drum, a single beam 1 watt solid state diode laser emitting at 830 nm (available from Optopower) at energy density between 200 and 800 mJ/cm$^2$. The plate was tested on an AB Dick press with Sun Chemical Drilith "H" Ink (available from Sun Chemical) in the absence of fountain solution. Before printing, the debris at the exposed area was gently cleaned with a cotton cloth wetted with soap water. The exposed area produced high optical printing image while the non-exposed area remained clean. The plate can be printed to more than 10,000 copies without deterioration.

EXAMPLE 16

A waterless printing plate was prepared similarly to the procedure of Example 13, excepted that the near infrared absorbing ink repelling cross-linked silicone polymer obtained similarly to Example 9 (i.e., ADS-004-Si) was used to coat on the near infrared absorbing adhesion promoting layer using a wire-wound rod. The coating was dried under hot air and cured at 120° C. for 5 minutes to produce a uniform coating having a coating weight at around 1.0 g/m$^2$. The plate was imaged with a home-built laser image-setter, which was equipped with an aluminum drum, a single beam 1 watt solid state diode laser emitting at 830 nm (available from Optopower) at energy density between 200 and 800 mJ/cm$^2$. The plate was tested on an AB Dick press with Sun Chemical Drilith "H" Cyan Ink (available from Sun Chemical) in the absence of fountain solution. Before printing, the debris at the exposed area was gently cleaned with a cotton cloth wetted with soap water. The exposed area produced high optical printing image while the non-exposed area remained clean. The plate can be printed to more than 10,000 copies without deterioration.

EXAMPLE 17

A waterless printing plate was prepared similarly to the procedure of Example 13, excepted that the near infrared absorbing ink repelling cross-linked silicone polymer obtained similarly to Example 12 (i.e., ADS-007-Si) was used to coat on the near infrared absorbing adhesion promoting layer using a wire-wound rod. The coating was dried under hot air and cured at 120° C. for 5 minutes to produce a uniform coating having a coating weight at around 1.0 g/m$^2$. The plate was imaged with a home-built laser image-setter, which was equipped with an aluminum drum, a single beam 1 watt solid state diode laser emitting at 830 nm (available from Optopower) at energy density between 200 and 800 mJ/cm$^2$. The plate was tested on an AB Dick press with Sun Chemical Drilith "H" Cyan Ink (available from Sun Chemical) in the absence of fountain solution. Before printing, the debris at the exposed area was gently cleaned with a cotton cloth wetted with soap water. The exposed area produced high optical printing image while the non-exposed area remained clean. The plate can be printed to more than 10,000 copies without deterioration.

EXAMPLE 18

A waterless printing plate was prepared similarly to Example 15, excepted that the near infrared absorbing polymer obtained from Example 3 (i.e., ADS-003-CTP) was used to prepare the near infrared adhesion promoting layer. The plate was imaged with a home-built laser image-setter, which was equipped with an aluminum drum, a single beam 1 watt solid state diode laser emitting at 830 nm (available from Optopower) at energy density between 200 and 800 mJ/cm$^2$. The plate was tested on an AB Dick duplicator press with Sun Chemical Drilith "H" Cyan Ink (available from Sun Chemical) in the absence of fountain solution. Before printing, the debris at the exposed area was gently cleaned with a cotton cloth wetted with soap water. The exposed area produced high optical printing image while the non-exposed area remained clean. The plate can be printed to more than 10,000 copies without deterioration.

Although the invention has been described above with respect with one specific form, it will be evident to a person skilled in the art that it may be modified and refined in various ways. It is therefore wished to have it understood that the present invention should not be limited in scope, except by the terms of the following claims.

I claim:

1. A thermal waterless printing plate suitable for near infrared laser imaging, said printing plate comprising: (i) a support substrate, and (ii) a composite top layer consisting of:

(a) a near infrared absorbing adhesion promoting layer applied to the support substrate and (b) a near infrared absorbing ink repelling cross-linked silicone polymer layer wherein said near infrared absorbing adhesion promoting layer comprises inherent near infrared absorbing polymers exhibiting strong absorption at wavelengths between about 780 and about 1200 nm, said polymers being capable of forming covalent bonds with the near infrared absorbing ink repelling cross-linked silicone polymer layer, said polymers having a structure according to formula I:

Formula I

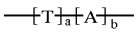

wherein a and b represent molar ratios, which vary from 0.1 to 0.9,

T represents near infrared transparent repeating segment, which may have a structure according to Formula II, III, IV, and V, Formula II

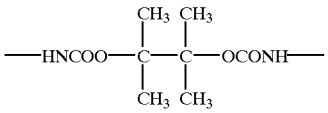

Formula III

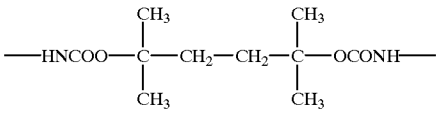

Formula IV

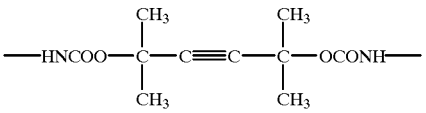

-continued

Formula V

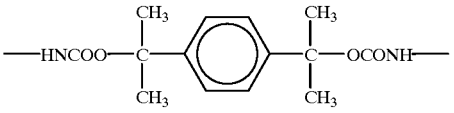

A represents near infrared absorbing repeating segment, which may have a structure according the Formula VI, Formula VI

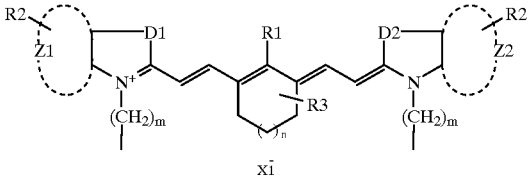

wherein

Z1 and Z2 represent sufficient atoms to form a fused substituted or unsubstituted aromatic rings, such as phenyl and naphthyl, D1 and D2 represent —O—, —S—, —Se—, —CH═CH—, and —$C(CH_3)_2$—

R1 and R2 represent alkyl, alkyloxy, alkyl halide, alkyl pyridine, allyloxy, vinyloxy, alkylthio, arylthio, aminothiophenol, sulfoalkyl, and carboxyalkyl substitution, R3 represents hydrogen, alkyl, and aryl substitution, X1 represents an anionic counter ion selected from bromide, chloride, iodide, tosylate, triflate, trifluoromethane carbonate, dodecyl benzosylfonate and tetrafluoroborate, n represents 0 and 1, m varies from 1 to 18.

2. The thermal waterless printing plate of claim 1 wherein said near infrared absorbing adhesion promoting layer further comprises binder resins which are transparent to near infrared radiation.

3. The thermal waterless printing plate of claim 2 wherein the binder resins are selected from the group of polymers containing monomer units derived from nitrocellulose, hydroxyalkylcellulose, styrene, carbonate, amide, urethane, acrylate, vinyl alcohol, and ester, and mixtures thereof.

4. The thermal waterless printing plate of claim 1 wherein the support substrate is made of any suitable sheet material selected from materials consisting of metal, plastic, composite and paper.

5. A thermal waterless printing plate suitable for near infrared laser imaging, said printing plate comprising: (I) a support substrate, and (ii) a composite top layer consisting of:

(a) a near infrared absorbing adhesion promoting layer applied to the support substrate and (b) a near infrared absorbing ink repelling cross-linked silicone polymer layer wherein said near infrared absorbing ink-repelling layer comprises cross-linked silicone polymers having near infrared absorption repeating units selected from the cross-linked silicone polymeric networks according to Formula VIII, IX and X:

Formula VIII

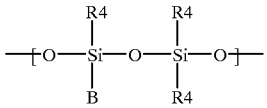

Formula IX

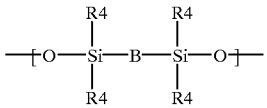

Formula X

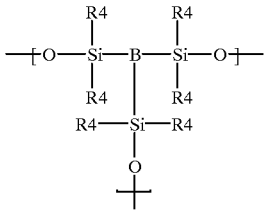

wherein

—$(R4)_2$—Si—O— represents a cross-linked silicone polymeric networks,

R4 represents methyl, ethyl and aryl substitution of the cross-linked silicone polymeric networks, B represents near infrared absorbing repeating units, which exhibits strong absorption bands between 780 and 1200 nm. The near infrared absorption repeating units comprise derivatives of indole, benz[e]indole, benz[cd]indole, benzothiazole, napthothiazole, benzoxazole, napthoxazole, benzselenazole, and napthoselenazole, which can be represented according to Formula XI, XII and XIII:

Formula XI

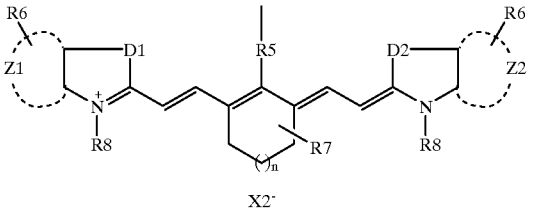

Formula XII

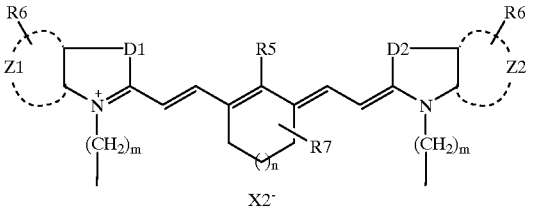

-continued

Formula XIII

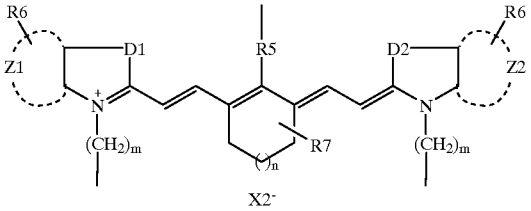

wherein

Z1 and Z2 represent sufficient atoms to form a fused substituted or unsubstituted aromatic rings, such as phenyl and naphthyl, D1 and D2 represent —O—, —S—, —Se—, —CH═CH—, and —$C(CH_3)_2$—

R5 represents alkyl, alkyloxy, alkyl halide, pyridine, alkyl pyridine and alkylthio, R6 represents alkyl, sulfonyl alkyl, and carboxy alkyl substitution, R7 represents hydrogen, alkyl and aryl substitution, R8 represents alkyl, benzyl, alkyl amine, alkyl sulfonic acid, alkyl carboxylic acid substitution, X2 represents an anionic counter ion selected from bromide, chloride, iodide, tosylate, triflate, trifluoromethane carbonate, dodecyl benzosylfonate and tetrafluoroborate, n represents 0 and 1, m varies from 1 to 18.

6. The thermal waterless printing plate of claim 5 wherein said near infrared absorbing ink-repelling layer comprises cross-linked silicone polymers having near infrared absorption repeating units selected from the cross-linked silicone polymeric networks according to Formula VIII, IX and X:

Formula VIII

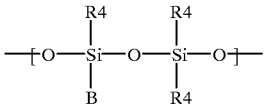

Formula IX

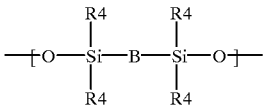

Formula X

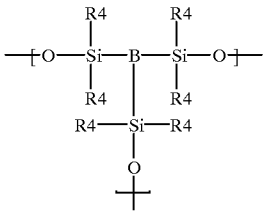

wherein

—$(R4)_2$—Si—O— represents a cross-linked silicone polymeric networks,

R4 represents methyl, ethyl and aryl substitution of the cross-linked silicone polymeric networks, B represents near infrared absorbing repeating units, which exhibits strong absorption bands between 780 and 1200 nm. The near infrared absorption repeating units comprise derivatives of indole, benz[e]indole, benz[cd]indole, benzothiazole, napthothiazole, benzoxazole, napthoxazole, benzselenazole, and napthoselenazole, which can be represented according to Formula XI, XII and XIII:

Formula XI

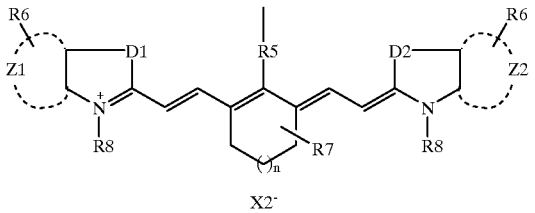

Formula XII

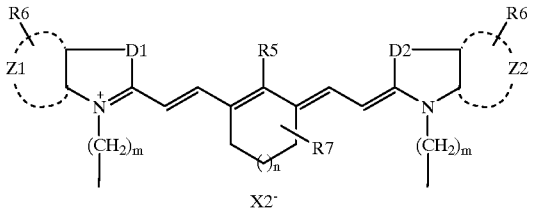

Formula XIII

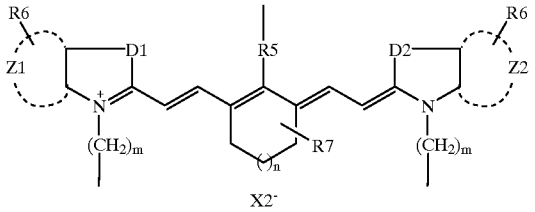

wherein

Z1 and Z2 represent sufficient atoms to form a fused substituted or unsubstituted aromatic rings, such as phenyl and naphthyl, D1 and D2 represent —O—, —S—, —Se—, —CH═CH—, and —$C(CH_3)_2$—

R5 represents alkyl, alkyloxy, alkyl halide, pyridine, alkyl pyridine and alkylthio, R6 represents alkyl, sulfonyl alkyl, and carboxy alkyl substitution, R7 represents hydrogen, alkyl and aryl substitution, R8 represents alkyl, benzyl, alkyl amine, alkyl sulfonic acid, alkyl carboxylic acid substitution, X2 represents an anionic counter ion selected from bromide, chloride, iodide, tosylate, triflate, trifluoromethane carbonate, dodecyl benzosylfonate and tetrafluoroborate, n represents 0 and 1, m varies from 1 to 18.

7. A printing plate coating composition for thermal waterless printing, said coating composition comprising a composite two-layer structure, the first layer to be applied to a suitable sheet substrate and the second layer to be applied on top of said first layer once said first layer is dried, said first layer consisting of a near infrared absorbing adhesion promoting layer applied to the support substrate and said second layer consisting of a near infrared absorbing ink repelling cross-linked silicone polymer layer, wherein said first and near infrared absorbing adhesion promoting layer comprises near infrared absorbing polymers exhibiting strong absorption at wavelengths between about 780 and about 1200 nm, said polymers being capable of forming covalent bonds with the second and near infrared absorbing ink repelling cross-linked silicone polymer layer, said polymers of said first layer having a structure according to formula I:

Formula I

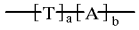

wherein a and b represent molar ratios, which vary from 0.1 to 0.9,

T represents near infrared transparent repeating segment, which may have a structure according to Formula II, III, IV, and V, Formula II

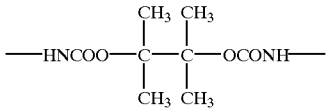

Formula III

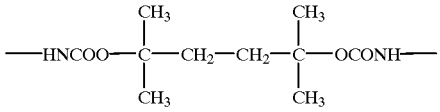

Formula IV

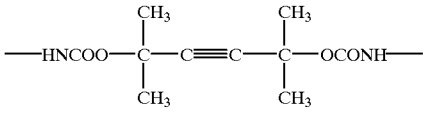

Formula V

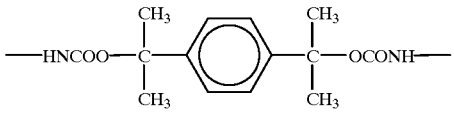

A represents near infrared absorbing repeating segment, which may have a structure according the Formula VI, Formula VI

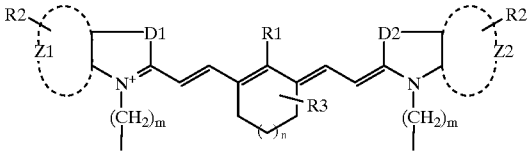

wherein

Z1 and Z2 represent sufficient atoms to form a fused substituted or unsubstituted aromatic rings, such as phenyl and naphthyl, D1 and D2 represent —O—, —S—, —Se—, —CH═CH—, and —$C(CH_3)_2$—

R1 and R2 represent alkyl, alkyloxy, alkyl halide, alkyl pyridine, allyloxy, vinyloxy, alkylthio, arylthio, aminothiophenol, sulfoalkyl, and carboxyalkyl substitution, R3 represents hydrogen, alkyl, and aryl substitution, X1 represents an anionic counter ion selected from bromide, chloride, iodide, tosylate, triflate, trifluoromethane carbonate, dodecyl benzosylfonate and tetrafluoroborate, n represents 0 and 1, m varies from 1 to 18.

8. The coating composition of claim 7 wherein said first and near infrared absorbing adhesion promoting layer further comprises binder resins which are transparent to near infrared radiation.

9. The coating composition of claim 8 wherein the binder resins are selected from the group of polymers containing monomer units derived from nitrocellulose, hydroxyalkylcellulose, styrene, carbonate, amide, urethane, acrylate, vinyl alcohol, and ester, and mixtures thereof.

10. The coating composition of claim 7 wherein said second and near infrared absorbing ink-repelling layer comprises cross-linked silicone polymers having near infrared absorption repeating units selected from the cross-linked silicone polymeric networks according to Formula VIII, IX and X:

Formula VIII

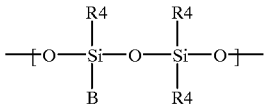

Formula IX

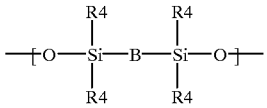

Formula X

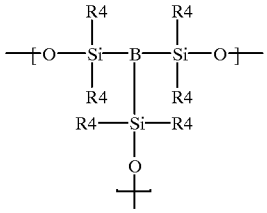

wherein

—$(R4)_2$—Si—O— represents a cross-linked silicone polymeric networks,

R4 represents methyl, ethyl and aryl substitution of the cross-linked silicone polymeric networks, B represents near infrared absorbing repeating units, which exhibits strong absorption bands between 780 and 1200 nm. The near infrared absorption repeating units comprise derivatives of indole, benz[e]indole, benz[cd]indole, benzothiazole, napthothiazole, benzoxazole, napthoxazole, benzselenazole, and napthoselenazole, which can be represented according to Formula XI, XII and XIII:

Formula XI

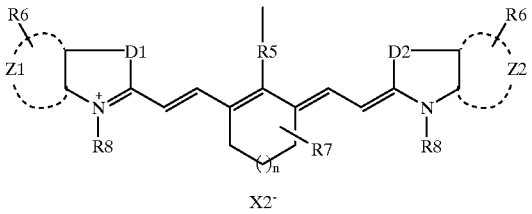

Formula XII

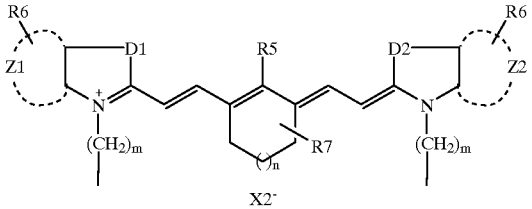

Formula XIII

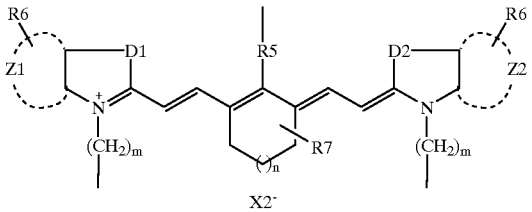

wherein

Z1 and Z2 represent sufficient atoms to form a fused substituted or unsubstituted aromatic rings, such as phenyl and naphthyl, D1 and D2 represent —O—, —S—, —Se—, —CH═CH—, and —$C(CH_3)_2$—

R5 represents alkyl, alkyloxy, alkyl halide, pyridine, alkyl pyridine and alkylthio, R6 represents alkyl, sulfonyl alkyl, and carboxy alkyl substitution, R7 represents hydrogen, alkyl and aryl substitution, R8 represents alkyl, benzyl, alkyl amine, alkyl sulfonic acid, alkyl carboxylic acid substitution, X2 represents an anionic counter ion selected from bromide, chloride, iodide, tosylate, triflate, trifluoromethane carbonate, dodecyl benzosylfonate and tetrafluoroborate, n represents 0 and 1, m varies from 1 to 18.

* * * * *

UNITED STATES PATENT AND TRADEMARK OFFICE

CERTIFICATE OF CORRECTION

PATENT NO. : 6,132,933

DATED : October 17, 2000

INVENTOR(S) : My T. Nguyen

It is certified that error appears in the above-identified patent and that said Letters Patent are hereby corrected as shown below:

On the cover page of the patent, at item "[75]" please correct the name of the inventor to --My T. Nguyen-- instead of "Ny T. Nguyen".
Item [75] should read: --[75] Inventor: My T. Nguyen, Kirkland, Canada"--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*